US006000622A

United States Patent [19]

Tonner et al.

[11] Patent Number: 6,000,622

[45] Date of Patent: Dec. 14, 1999

[54] AUTOMATIC CONTROL OF AIR DELIVERY IN FORCED AIR FURNACES

[75] Inventors: Robert B. Tonner; Steven G. McNutt, both of Pickering, Canada

[73] Assignee: Integrated Control Devices, Inc., Pickering, Canada

[21] Appl. No.: 08/859,784

[22] Filed: May 19, 1997

[51] Int. Cl.[6] ..... F24D 5/10

[52] U.S. Cl. ..... 236/11; 165/247

[58] Field of Search ..... 236/10, 11, 9 R, 236/9 A, 15 BP, 38; 165/247, 299

[56] References Cited

U.S. PATENT DOCUMENTS

| | | | |
|---|---|---|---|
| 3,454,078 | 7/1969 | Elwart | 236/10 X |
| 3,985,294 | 10/1976 | Guido et al. | 236/15 C |
| 4,502,625 | 3/1985 | Mueller | 236/11 |
| 4,706,881 | 11/1987 | Ballard | 236/15 BD |
| 4,792,089 | 12/1988 | Ballard | 236/11 |
| 4,907,737 | 3/1990 | Williams | 236/11 |
| 5,491,775 | 2/1996 | Madau et al. | 315/3 |
| 5,524,556 | 6/1996 | Rowlette | 110/162 |
| 5,590,642 | 1/1997 | Borgeson et al. | 236/11 X |

*Primary Examiner*—Harry B. Tanner
*Attorney, Agent, or Firm*—Dowell & Dowell, P.C.

[57] ABSTRACT

A forced air furnace circulation fan controller adjusts the speed of the circulation fan according to the incidence of air delivery restrictions. Upon detecting insufficient air delivery as a function of the temperature of the furnace heat exchanger, the control system increases the circulation fan speed to increase the air delivery within the heating system. The controller utilizes fuzzy logic techniques to determine a speed adjustment for the furnace fan motor, based on the value of the furnace heat exchanger temperature. The use of fuzzy logic control allows the circulation fan controller to provide a highly adaptive response to changes in air delivery. The resulting balanced air delivery provides for efficient furnace operation and superior occupant comfort.

20 Claims, 8 Drawing Sheets

AUTOMATIC CONTROL OF AIR DELIVERY IN FORCED AIR FURNACES

FIELD OF THE INVENTION

This invention relates to forced air furnace controls, more particularly to air delivery controls for such furnaces.

BACKGROUND OF THE INVENTION

A forced air furnace forces heated air into a home using a circulation fan which delivers air over the furnace's heat exchanger and into the duct distribution system. The air is then returned to the furnace through intake vents for re-circulation through the heating system. In order for a forced air furnace to run most efficiently, the air delivery of the heating system should remain relatively constant at a certain fixed value of cubic feet of air per minute. The air delivery of a heating system is a function of the air pressure produced by the circulation fan and air delivery restrictions in the heating system. The static pressure present within a heating system is indicative of the air delivery for a fixed circulation fan speed. Static pressure is the steady state pressure that exists within a system for a fixed fan speed and is commonly measured in units of inches of water.

Typically, installers of forced air furnaces are responsible for determining and implementing the correct fan speed for each installation. Static pressure and other heating characteristics must be measured to determine an efficient air delivery rate for the particular air duct restrictions and characteristics of a heating system. After a forced air furnace is installed, further changes in air delivery restrictions requires further air delivery speed adjustments. However, air delivery installation testing and adjusting is rarely done in practice and post-installation air delivery adjustments are not likely to be made by the dwelling occupants.

Air delivery restrictions can be caused by duct blockages such as dirty air filters, dust and dirt build up, and other restrictions in the vents. Factors relating to the specific configuration of the vent system also affect air delivery, such as the width and length of the ducts used and the number of elbows in a duct passage. The opening and closing of individual warm air registers or cold air return vents also significantly affect the air delivery rate of a given installation. The presence of air delivery resistance produces a decrease in the air delivery of a furnace and reduces heating system efficiency.

Furnace efficiency is related to a balanced air delivery at a particular heat rise. Heat rise is the difference between the temperature of the warm air being produced by the furnace and that of the cold intake air. For efficient furnace operation, it is known that the heat rise should remain constant at a value of approximately 70° F. When air delivery restrictions are present in a heating system, the rate of air delivery is reduced and heat rise is increased. Furnace efficiency is decreased due a slower stream of air passing through the heat exchanger at a comparable temperature to that of the heat exchanger. This results in a significant amount of heat not being transferred from the heat exchanger to the air being delivered over the heat exchanger. This heat is then lost through the combustion flue. This inefficiency also results in hotter vented combustion products and may present problems for plastic vent materials.

One solution is to install a manual fan speed control device which allows a home owner to manually adjust circulation fan speed. However, these systems are commonly set and left for long periods of time at high speed settings in order that as much heat as possible is efficiently extracted from the heat exchanger. Air moving at higher velocities results in the cooling of human skin due to increased evaporation of moisture on the skin's surface and causes discomfort to the occupants. In addition, increased air velocities result in increased noise within the building. While this solution is relatively inexpensive, it is inefficient and unreliable as a long term solution as such manual adjustments can be made in error or not at all due to the device's inability to automatically adapt to changing air delivery resistances.

Other fan speed control systems control circulation fan speed to delay the execution of safety shut-down procedures when the system reaches dangerous operating levels. For example, U.S. Pat. Nos. 4,705,881 and 4,792,089 to Ballard, both disclose a furnace control system which increases the speed of an air blower by alternately engaging higher motor speed windings when the temperature of air to be heated exceeds a pre-determined temperature. When high-limit conditions are detected, the control system advances the speed of the circulation fan in association with higher motor windings, typically over two or three motor speeds. The controller stops increasing fan speed if the temperature drops below the pre-determined temperature. However, if the top fan speed is reached and the temperature remains above the predetermined temperature then shut down procedures are initiated. While this control system varies the circulation fan speed in response to detected air delivery resistance, it does not allow the circulation fan speed to be adaptively increased or decreased during the normal course of operation in response to varying air delivery resistances.

More sophisticated attempts to address changes in air delivery due to air delivery restrictions have involved attempts to control the fan motor speed in response to changes in motor load characteristics during normal operating conditions. For example, U.S. Pat. No. 5,524,556 to Rowlette et al. discloses a fan motor controller which detects changes in parameters such as motor torque and motor speed and makes corrections to the fan motor to maintain constant air delivery despite changes in air delivery resistances. Corrections are made using a microprocessor which reads motor speed and torque and then computes desired speed based on a torque-speed characteristic stored in memory. However, such reactive control techniques typically result in fan speed changes of more than 15% which causes undesirable wind chill effects. Thus, while circulation fan speed is being adjusted during the course of normal operation, this solution is only partially effective due to its crudely reactive nature and associated construction and installation costs.

Accordingly, there is a long-standing need to improve the efficiency of forced air furnaces, to improve the level of occupant comfort, and to eliminate the need for air delivery calibration as part of the furnace installation procedure, using a control system which provides a highly adaptive response to changes in air delivery and which is relatively inexpensive to manufacture and install.

SUMMARY OF THE INVENTION

The present invention is directed to a furnace air delivery control apparatus for a forced air furnace having a heat exchanger, a fan, and a fan motor, comprising temperature sensing means, signal conditioning means, a controller, and speed adjusting means. The temperature sensing means is operatively coupled to the heat exchanger to sense the temperature thereof and to generate sensor signals correlatable therewith. The signal conditioning means is operatively coupled to the temperature sensing means to condition the sensor signals and to generate conditioned temperature signals. The controller is operatively coupled to signal conditioning means and includes means for utilizing the conditioned temperature signals to continuously determine speed adjustment factors for adjusting the speed of the fan motor so as to maintain a constant air delivery. The controller also generates output signals correlatable with the speed adjustment factors. The speed adjusting means is operatively coupled to the controller and to the fan motor, and adjusts the speed of the fan motor based on the output signals.

The present invention is also directed towards a method for controlling furnace air delivery, starting with sensing the temperature of the heat exchanger and generating sensor signals correlatable therewith. The sensor signals are then conditioned and conditioned temperature signals are generated. The conditioned temperature signals are then processed and speed adjustment factors are then continuously determined based thereupon. Output signals correlatable with the speed adjustment factors are generated and the speed of the fan motor is adjusted in accordance with the output signals.

BRIEF DESCRIPTION OF THE DRAWINGS

The invention will now be described, by way of example only, with reference to the following drawings, in which.

DETAILED DESCRIPTION OF THE PREFERRED EMBODIMENT

Figure 1:
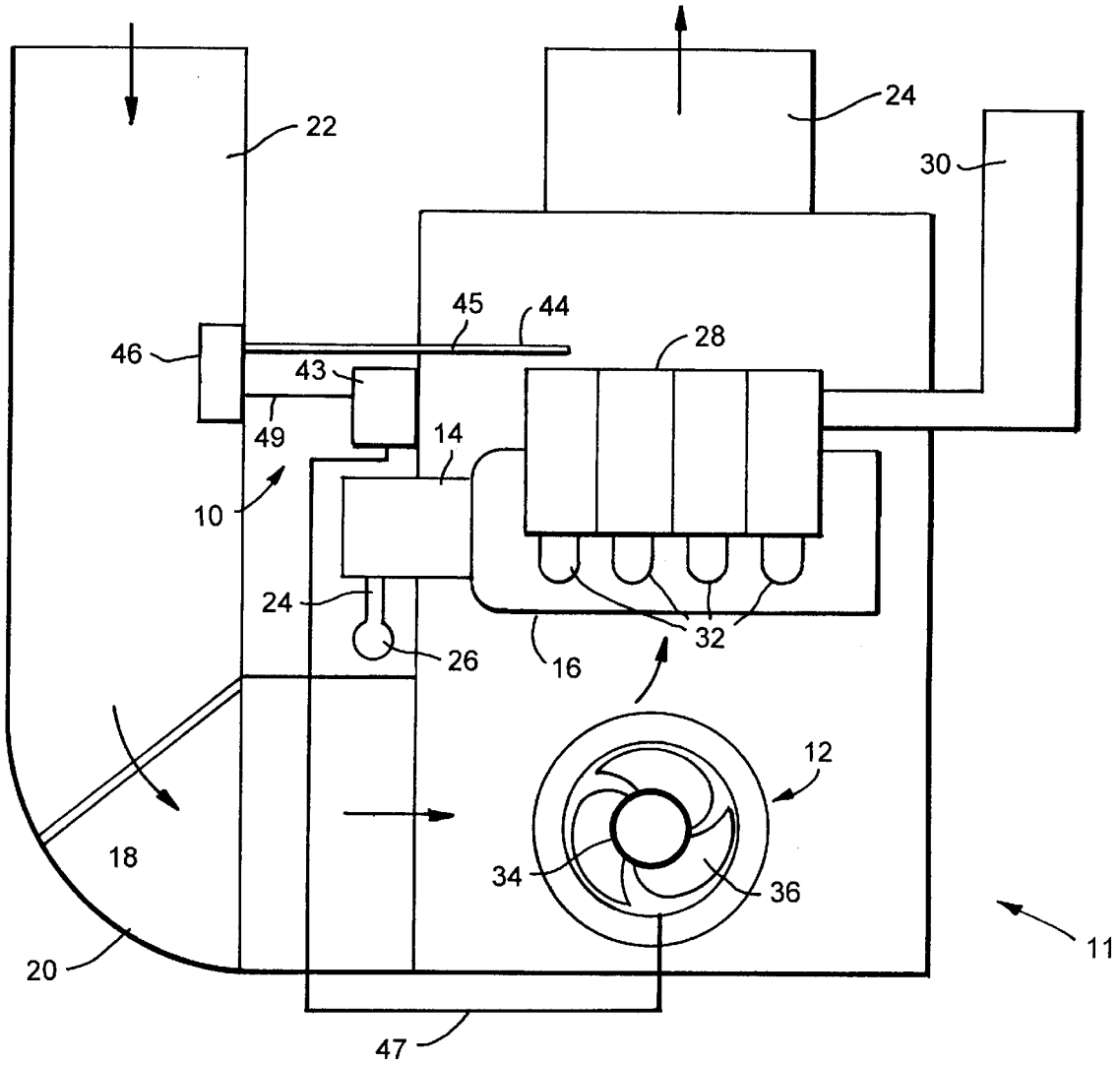
FIG. 1 is a diagrammatic view of a typical forced warm-air furnace in association with the present invention.

Referring to FIG. 1, illustrated therein is control apparatus made in accordance with a preferred embodiment of the invention, shown generally as 10, installed on a conventional forced warm-air residential furnace 11 of a gas fired type. Furnace 11 includes a circulation fan 12, burner 14, combustion chamber 16, air filter 18, and furnace housing 20. Furnace housing 20 has a cold air return 22 and a warm air outlet 24.

Cold air return 22 consists of ducts which are generally of rectangular cross section and which direct air first through air filter 18, through circulation fan 12, and along the outside of combustion chamber 16. Burner 14 is connected through a gas infeed pipe 24 to a gas supply pipe 26 and provides a constant rate of heat delivery to combustion chamber 16 of approximately 30,000 BTU and up. The rate of heat delivery is dependent on the gas pressure and the pipe nozzle design of infeed pipe 24.

Furnace 11 also comprises a heat exchanger 28, a flue gas outlet 30, and four hot gas inlets 32. Flue gas outlet 30 passes hot flue gases from heat exchanger 28. Heat exchanger 28 is typically of the multiple tube type to which provides a large heat transfer surface. Hot gas inlets 32 provides heat exchanger 28 with hot gases from combustion chamber 16.

Circulation fan 12 includes a fan motor 34 and a set of fan blades 36. The rotor of fan motor 34 is a alternating current (AC) direct drive induction motor directly connected to fan blades 36 to which it provides motive power. Circulation fan 12 circulates air from the cold air return 22 such that it passes over heat exchanger 28. The air is heated by heat exchanger 28 and is forced through warm air outlet 24, through the heating ducts, and into the dwelling.

Control apparatus 10 includes a control module 43, thermocouple 44, and terminal block 46. Control module 43 is attached to furnace housing 20 in close proximity to cold air return 22 and heat exchanger 28 and contains the controller electronics described hereinbelow. Control module 43 receives an adjusted temperature voltage signal from terminal block 46 and provides adjustable power through a power cable 47 to fan motor 34.

Thermocouple 44 is welded to the wall of heat exchanger 28 to sense the temperature of heat exchanger 28. A thermocouple is a device that consists of two dissimilar conductors welded together at their ends to form a junction. When heated the junction generates a voltage proportional to the rise in temperature. Thermocouple 44 is preferably a well known J-Type device consisting of two dissimilar conductors 45 such as Iron and Constantan welded at their ends. Upon heating, the junction of conductors 45 develops a voltage in proportion to the temperature rise and has a range of detection of approximately 1800° F. Conductors 45 are electrically coupled to terminal block 46 and provides terminal block 46 with a voltage signal related to the temperature of heat exchanger 28.

Terminal block 46 is a standard temperature source and is positioned on the duct wall of cold air return 22 such that its temperature remains stable typically to within 5° F. between 68 and 73° F., although terminal block may alternatively be placed in any system location which has a similarly stable temperature. Terminal block 46 is used as a reference voltage for the calibration of the temperature voltage signal produced by thermocouple 44 and sends an adjusted referenced temperature voltage signal through a copper wire 49 to control module 43. Terminal block 46 may be alternatively implemented using an artificial temperature reference for greater accuracy and stability at additional expense.

Figure 2:
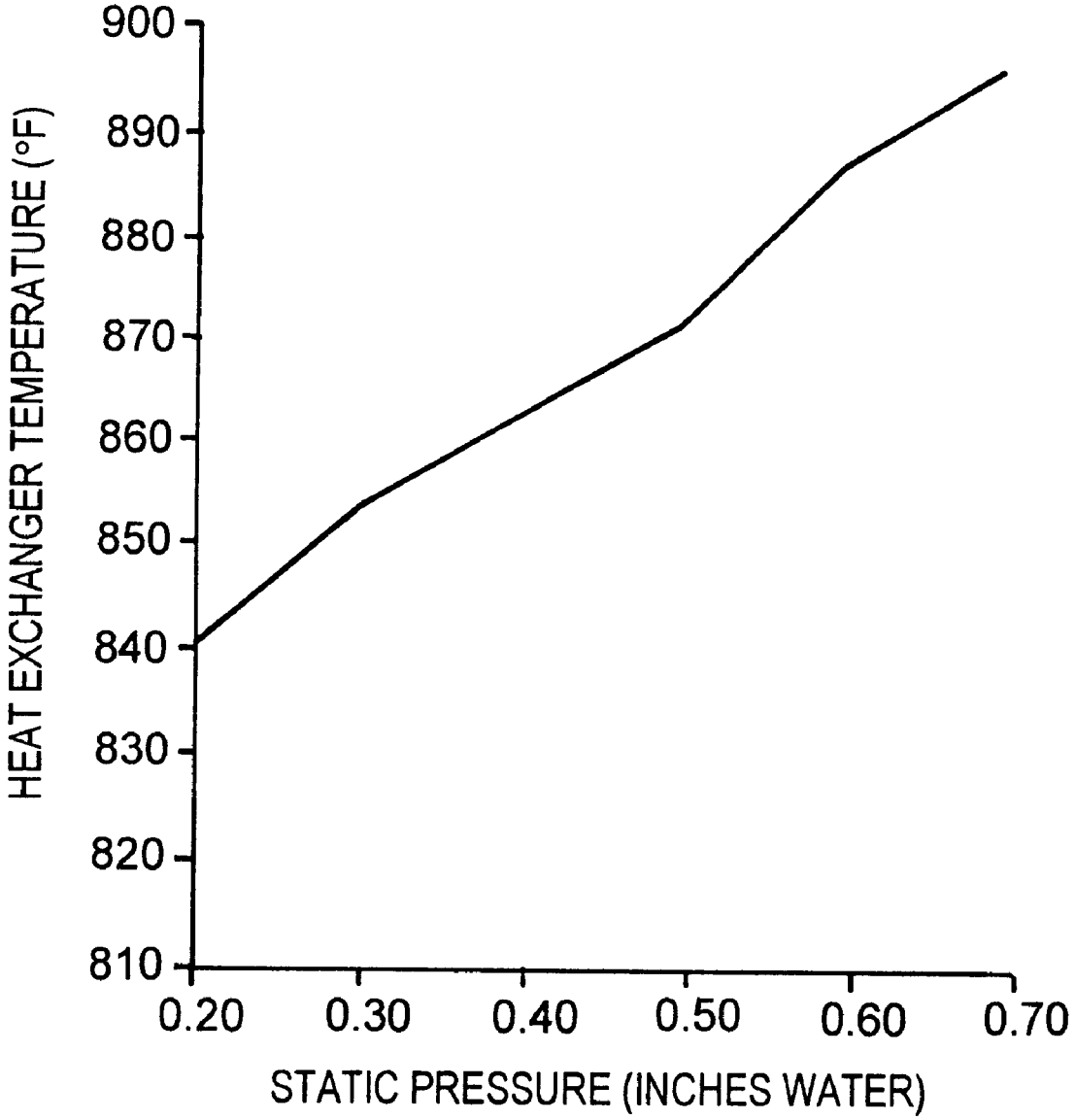
FIG. 2 is a graph showing the relationship between static pressure of a heating system and the temperature of the heat exchanger in a typical heating system at a fixed circulation fan speed.

Referring now to FIG. 2, one of the inventors of the subject invention has conducted various experiments to determine how best to achieve ideal air delivery within a heating system in response to changes in air delivery restrictions. The graph shows experimental data which indicates that for a fixed circulation fan speed, there is a linear relationship between the static pressure of furnace 11 and the temperature of heat exchanger 28. Since a decrease in air delivery at a particular circulation fan speed is accompanied by an increase in static pressure, and an increase in static pressure at a particular circulation fan speed results in a linear increase in the temperature of heat exchanger 28, a decrease in air delivery can be identified by a linear increase in the temperature of heat exchanger 28 at a particular speed of circulation fan 12.

Accordingly it has been determined that in order to maintain a balanced air delivery within the heating system, the speed of the fan motor 34 must be adjusted to respond to changes in the temperature of the exchanger 28 in such a way that the heating system compensates for the variation from an ideal air delivery operational set point. The observation and utilization of the linear relationship between the air delivery of furnace 11 and the temperature of heat exchanger 28 at a particular speed of circulation fan 12, allows the present invention to provide furnace 11 with a highly adaptable control system for maintaining efficient air delivery conditions.

Figure 3:
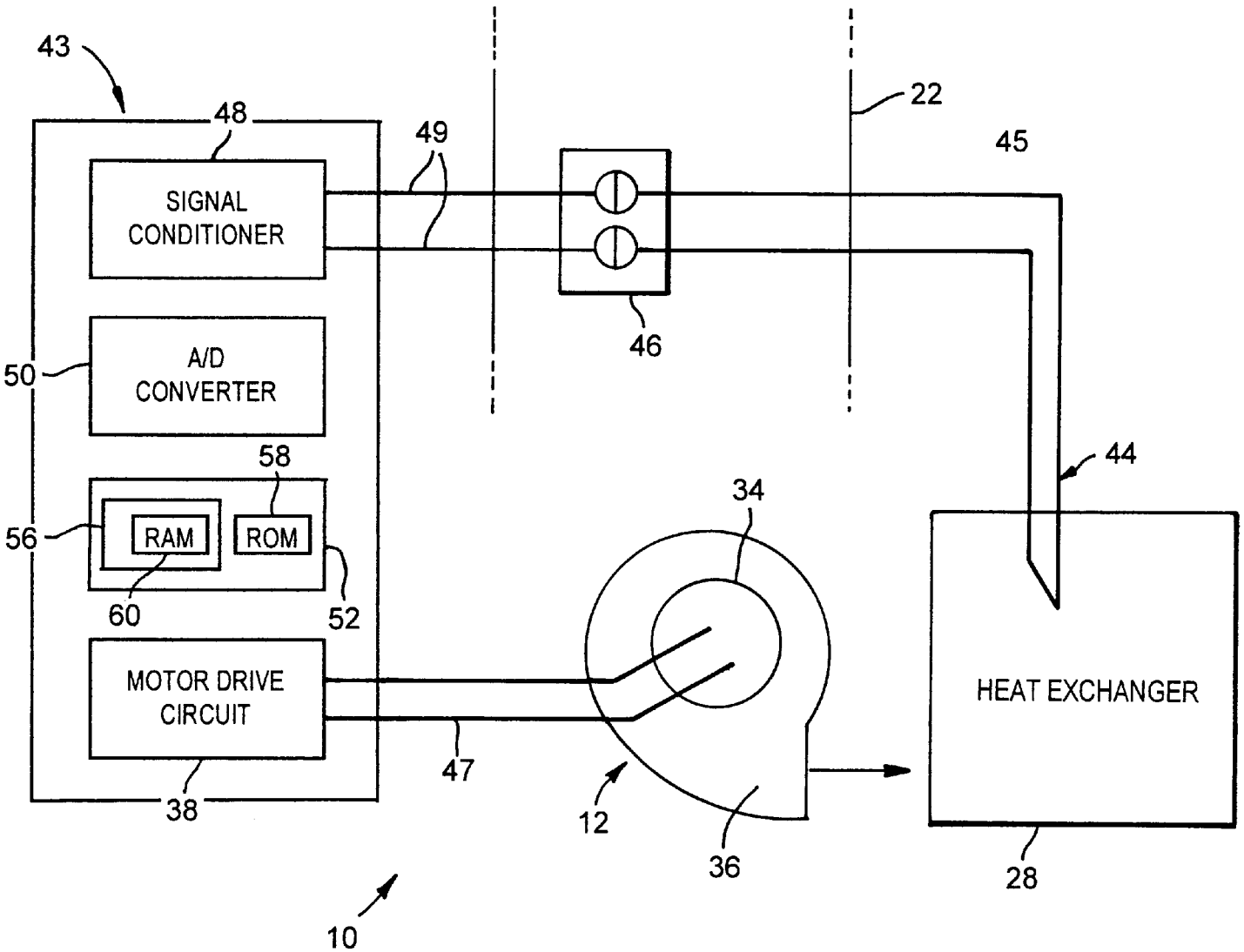
FIG. 3 is a block diagram of a preferred embodiment of the present invention.

Now referring to FIG. 3, thermocouple 44 senses the temperature of the heat exchanger 28 and sends temperature voltage signals over conductors 45 to terminal block 46, either positioned on the duct wall of cold air return 22 or at some other heating system location where temperature remains relatively stable. Terminal block 46 in turn sends an adjusted referenced temperature voltage signal through copper wire 49 to signal conditioner 48 within control module 43.

Control module 43 of control apparatus 10 comprises a signal conditioner 48, an analog to digital converter 50, a microcontroller 52, and a motor drive circuit 38.

Signal conditioner 48 receives a signal from terminal block 46, amplifies the signal, and provides the amplified signal to analog to digital converter 50. Analog to digital converter 50 is a 8 bit analog to digital converter, although a converter with a higher bit resolution can be used as desired. Further, Analog to digital converter 50 may be implemented within microcontroller 52. Analog to digital converter 50 produces a digital representation of the heat exchanger 28 temperature and provides this digital temperature value to microcontroller 52.

Microcontroller 52 includes a microprocessor 56, which may be RISC based, although it should be understood that other types of logic circuit with similar operating functions can be utilized. Storage of program instructions and other static data is provided by ROM (read only memory) 58, while storage of dynamic data is provided by RAM (random access memory) 60. Both ROM 58 and RAM 60 are controlled and accessed by microcontroller 52 in a conventional manner. ROM 58 can include additional non-volatile memory to store critical operational data. Microcontroller 52 provides motor drive circuit 38 with a speed adjustment factor based on the temperature and the rate of change of the temperature of heat exchanger 28 using fuzzy logic control techniques discussed in detail below.

It should be observed that in addition to providing motor drive circuit 38 with a speed adjustment factor to control the speed of circulation fan 12 in response to changing air delivery resistances, control apparatus 10 also implements the functionality of a conventionally known fan switch. Microcontroller 52 is designed to turn on circulation fan 12 when thermocouple 44 detects that the temperature of heat exchanger 28 is above a preselected upper limit of approximately 300° F. Microcontroller 52 is also programmed to turn off circulation fan 12 when thermocouple 44 detects that the temperature of heat exchanger 28 has dropped below a preselected lower limit. Microcontroller 52 also implements an emergency shut-down mechanism which turns off burner 14 when thermocouple 44 senses a "danger level" temperature of approximately 1000° F.

Motor drive circuit 38 obtains electrical power from the AC power line terminals that provides between 120 to 220 volts of AC power. Motor drive circuit 38 provides fan motor 34 with an adjusted level of power through power cable 47. Motor drive circuit 38 receives the speed adjustment factor from microcontroller 52 and generates an adjusted level of power in accordance with the speed adjustment factor. Motor drive circuit 38 utilizes phase modulation techniques to control the amount of output AC power supplied to fan motor 34, which directly affects the speed of fan motor 34 and fan blades 36.

Microcontroller 52 implements fuzzy logic control techniques to generate the speed adjustment factor, fuzzy logic being a well-known methodology for handling knowledge that contains some uncertainty or vagueness. The foundations of fuzzy logic were set forth by L. A. Zadeh in his paper entitled "Fuzzy Sets", INFORMATION AND CONTROL, Vol. 8 No. 3, June 1965, pp. 338–53. In current engineering applications, fuzzy logic is most often found in control problems in the form of a particular procedure, called "max-min" fuzzy inference as described by Ebrahim Mamdani in his paper entitled "Application of Fuzzy Logic to Approximate Reasoning Using Linguistic Synthesis", IEEE TRANSACTIONS ON COMPUTERS, (1977) C-26, No. 13, pp. 1182–1191. This procedure incorporates approximate knowledge of appropriate control response for different circumstances into sets of rules for calculating a particular control action.

Fuzzy logic control systems allow the possible state or signal values assumable by the system to be classified into "fuzzy sets" each defined by a membership function. A membership function associated with a given signal thus provides an indication of the degree-of-membership that the current value of that signal has with respect to the fuzzy set. Rules express both their conditions and their directives in terms of fuzzy sets. For each particular set of input variables, a value called "rule strength" can be determined for a particular rule based on the appropriate combination of degree-of-membership values for each membership function.

Various methods are used to determine a final directive based on the various rule strength values which have been generated. One common method is the "centre of gravity" method which takes into account both the various rule strengths and the shape of the various membership functions for the rule's output directive. Software implementation of the fuzzy logic control methodology can be developed according to conventional methods. Generally, a microcontroller would be programmed to generate control signal values in response to variable input signals in accordance with constraints imposed by propositions or "rules" stored in its memory.

Using fuzzy logic control techniques, microcontroller 52 achieves intuitive adaptive control of circulation fan 12 in response to fluctuations in the temperature of heat exchanger 28. Microcontroller 52 repeatedly inputs and processes digital heat exchange temperature values from analog to digital converter 50 to produce a sequence of values which are utilized by motor drive circuit 38 to drive circulation fan 12 at the precise speed to compensate for any variation in the temperature of heat exchanger 28 from an ideal set point.

Figure 4:
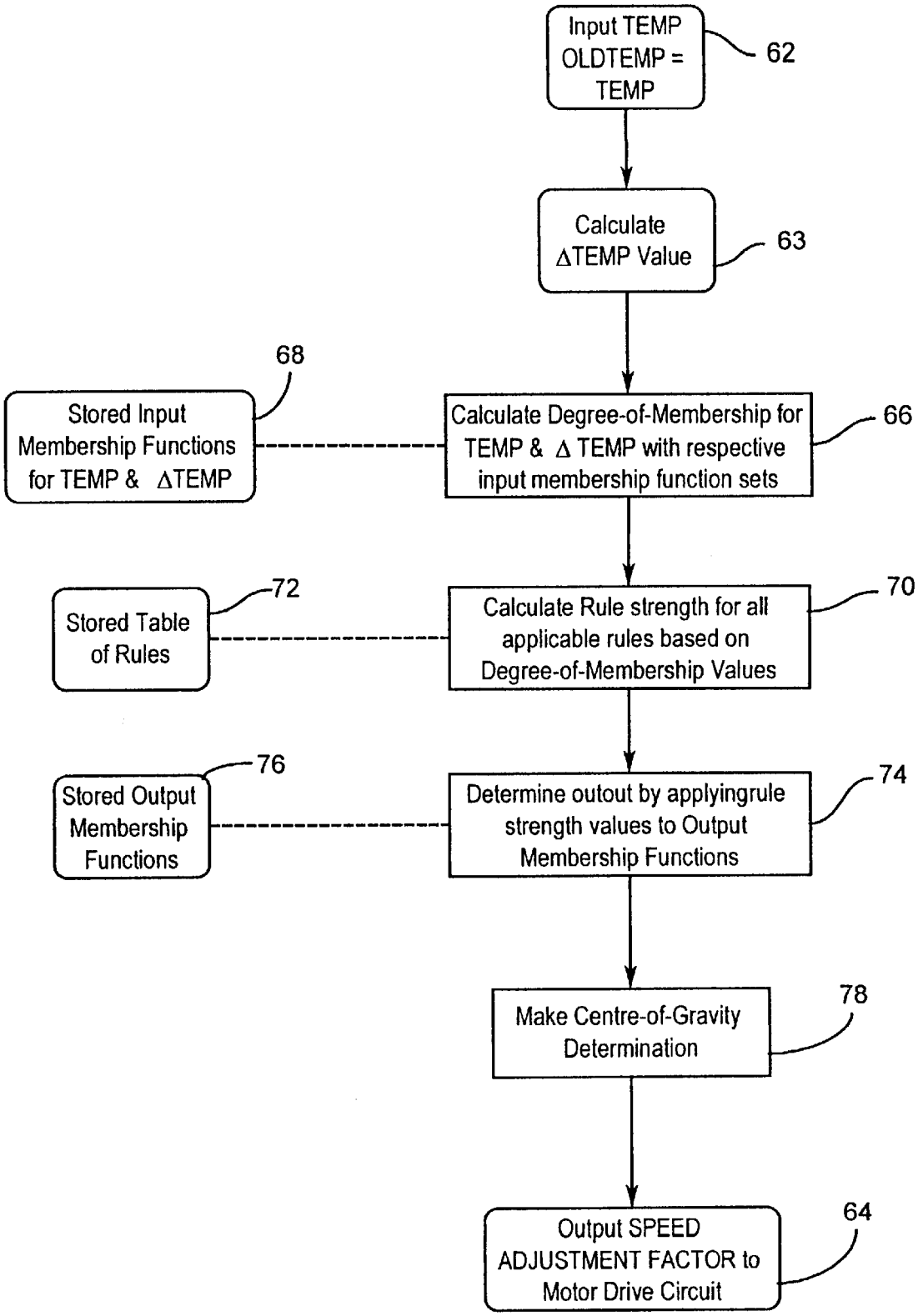
FIG. 4 is a flow chart showing the general workings of the fuzzy controller of the present invention.

Referring now to FIG. 4, microcontroller 52 performs general purpose fuzzy logic control functions starting at step 62, where microcontroller 52 inputs a digital temperature value from analog to digital converter 50 and stores the value in RAM 60 in a variable called TEMP after storing the previous value of TEMP in a variable called OLD TEMP. Microcontroller 52 inputs the digital temperature value from analog to digital converter 50 every 5 seconds. This input rate allows the controller operating system enough time to sense a change in the temperature while providing the microcontroller 52 with enough information to be sufficiently responsive to changes in temperature. At step 63, microcontroller 52 calculates the difference between variables TEMP and OLD TENT and stores the result in RAM 60 in a variable called ΔTEMP. Microcontroller repeatedly inputs and processes the variable TEMP and produces a sequence of output values stored in RAM 60 in a variable called SPEED ADJUSTMENT FACTOR at step 64.

Microcontroller 52 at step 66 first retrieves input membership functions stored in ROM 58 at block 68 and calculates the degree-of-membership value in those membership functions for variables TEMP and ΔTEMP. Variables TEMP and ΔTEMP each have their own set of input membership functions or input fuzzy sets, which characterize the possible values assumable by each input variable. Input variables which are outside a given input fuzzy set are assigned a zero degree-of-membership value, whereas input variables inside a fuzzy set have some non-zero integer degree-of-membership value.

At step 70, microcontroller 52 retrieves a table of rules stored in ROM 58 at block 72 along with the previously calculated degree-of-membership values to calculate the rule strength for all of the stored rules. Rule strength is determined by evaluating the numerical value of the logical combination of the input membership functions. The present invention implements all of the rules using a logical AND operator. The fuzzy logic equivalent of the AND operation is performed by selecting the minimum condition membership value among the conditions within a rule. Thus, in the present embodiment, rule strength is always the minimum degree-of-membership value for the TEMP and ΔTEMP input membership functions. Further, if either a TEMP or ΔTEMP membership function is totally unsatisfied in the condition, i.e. has a degree-of-membership value of zero, then the resulting rule strength is zero.

At step 74, stored output membership functions in ROM 58 at block 76 are retrieved by microcontroller 52 and evaluated using the rule strength values calculated above as inputs to produce a composite output figure comprised of the overlaying of each individual rule output function. At step 78, the output figure is "defuzzified" using a "centre of gravity" algorithm, although many other methods may be used to determine a "consensus value". It should be noted that each particular furnace installation will have unique input and output membership function curves relating to specific furnace design characteristics.

Figure 5A:
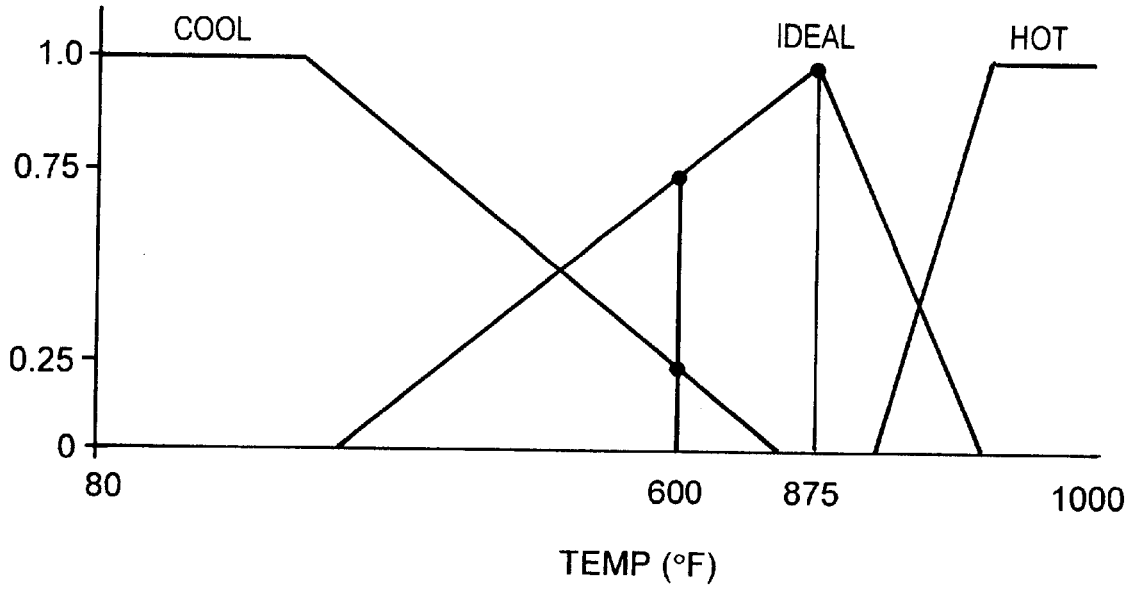
FIG. 5*a* is a graph showing example fuzzy controller input standard membership functions for various heat exchanger temperatures for the present invention.

As shown in FIG. 5*a*, the membership functions for variable TEMP consists of three fuzzy sets "cool", "ideal", and "hot". The result of the calculation of the degree-of-membership value at step 66 for each TEMP fuzzy set, will depend on the value of the variable TEMP and the TEMP input membership function curves for a particular installation such as those shown in FIG. 5*a*. Accordingly, if TEMP is 875° F., the ideal temperature for a typical heat exchanger, then the degree-of-membership value for the fuzzy set "ideal" will be 1 and 0 for fuzzy sets "cool" and "hot". If for example, TEMP is 600° F. then the temperature of heat exchanger 28 is appreciably less than the ideal temperature and fuzzy sets "cool" and "ideal" will have degree-of-membership values of 0.25 and 0.75 respectively, while fuzzy set "hot" will have degree-of-membership value 0.

Figure 5B:
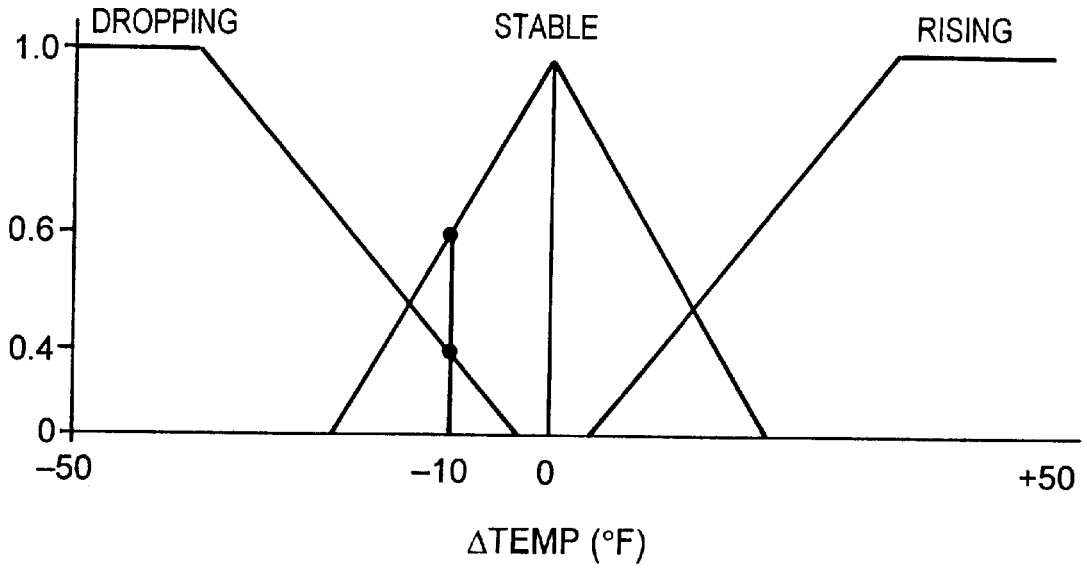
FIG. 5*b* is a graph showing example fuzzy controller input standard membership functions for various changes in temperature of the heat exchanger for the present invention.

As shown in FIG. 5*b*, the membership functions for the variable ΔTEMP consists of three fuzzy sets "dropping", "stable", and "rising". The result of the calculation of the degree-of-membership at step 66 for each ΔTEMP fuzzy set, will depend on the value of the variable ΔTEMP and the ΔTEMP input membership function curves for a particular installation such as those shown in FIG. 5*b*. If the value of ΔTEMP is 0 at step 66, then the temperature sensed at heat exchanger 28 has not changed from the last temperature reading, or TEMP equals OLDTEMP. Consequently, the degree-of-membership value for fuzzy set "stable" is 1 and it is 0 for fuzzy sets "dropping" and "rising". However, if the value of ΔTEMP is −10° F., then the degree-of-membership value for the fuzzy sets "stable" and "dropping" will be 0.6 and 0.4, respectively and 0 for fuzzy set "rising".

The truth table shown below illustrates the rules stored in ROM 58 at block 72 for all furnace designs.

| | DROPPING | STABLE | RISING |
|---|---|---|---|
| COOL | down_a_lot | down_a_little | no_change |
| IDEAL | down_a_little | no_change | up_a_little |
| HOT | no_change | up_a_litt1e | up_a_lot |

These rules embody basic control logic which increases fan speed when the temperature of heat exchanger 28 is above the ideal temperature and the temperature is either increasing or stable, decreases fan speed when the temperature of heat exchanger 28 is below the ideal temperature and the temperature is either stable or decreasing. This logic precludes any fan speed adjustment when the temperature is lower than ideal and increasing, the temperature is higher than ideal and decreasing, or ideal and stable. Such fan speed adjustments provide for increased air delivery to reduce the temperature of heat exchanger 28 when higher than ideal temperature conditions are detected and conversely, decreased air delivery to increase the temperature of heat exchanger 28 when lower than ideal temperature conditions are detected. Finally, if the heating system is at the ideal temperature and the temperature is stable, fan speed is not adjusted.

As discussed above, rule strength is determined at step 70 by evaluating the numerical value of the logical combination of the input membership functions, or the minimum degree-of-membership value for the appropriate TEMP and ΔTEMP input membership functions. For example, the rule "If TEMP is cool and ΔTEMP is dropping then SPEED ADJUSTMENT FACTOR should be down a lot" would be evaluated using the degree-of-membership values relating to the "cool" and "dropping" input membership functions. As an example, assume that TEMP is 600° F. and ΔTEMP is −10° F. Consequently, the rule strength for the example rule would be the minimum of the degree-of-membership values would be the minimum value of 0.25 and 0.4 or 0.25.

Figure 5C:
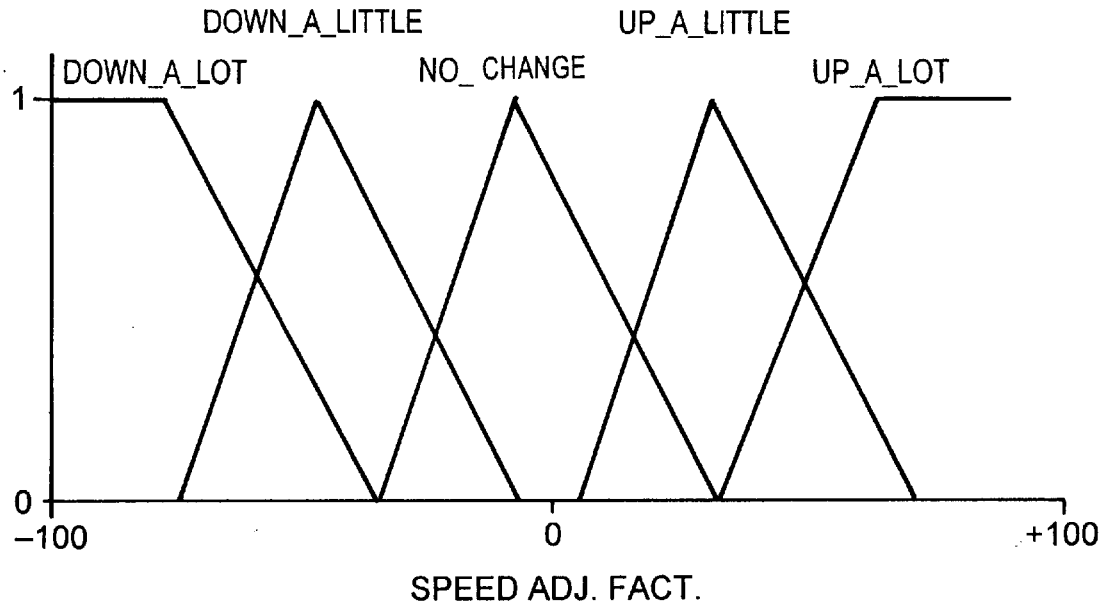
FIG. 5*c* is a graph showing example fuzzy controller output membership functions for various fan motor speed directions for the present invention.

As shown in FIG. 5*c*, the output membership functions for the variable SPEED ADJUSTMENT FACTOR consist of five output fuzzy sets "down a lot", "down a little", "no change", "up a little" and "up a lot". These output membership functions are evaluated using the rule strength values that were calculated at step 72 and the resulting function outputs are overlain on each other to produce a composite output characteristic. For the example membership functions, where the TEMP is 600° F. and ΔTEMP is −10° F., at step 70 the following non-zero rule strengths will be determined for the four relevant rules:

| RULE | RULE STRENGTH |
|---|---|
| "If TEMP is cool and ΔTEMP is dropping then SPEED ADJUSTMENT FACTOR should be down a lot" | .25 |
| "If TEMP is cool and ΔTEMP is stable then the SPEED ADJUSTMENT FACTOR should be down a little" | .25 |
| "If TEMP is ideal and ΔTEMP is dropping then SPEED ADJUSTMENT FACTOR should be down a little" | .4 |
| "If TEMP is ideal and ΔTEMP is stable then SPEED ADJUSTMENT FACTOR should be no change" | .6 |

Figure 5D:
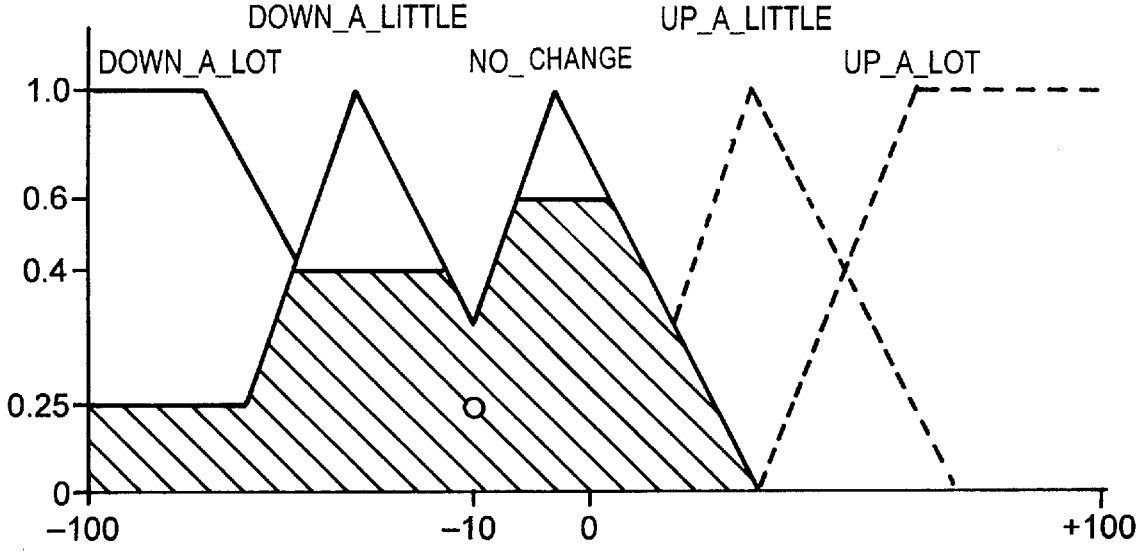
FIG. 5*d* is a graph showing an example "centre-of-gravity" determination for the present invention.

Referring now to FIG. 5*d*, these rule strengths are then applied to the output membership function to produce the composite output characteristic. At step 80, this output characteristic is "defuzzified" using a "centre of gravity" algorithm, although many other methods may be used to determine a "consensus value". In our example, the value of the variable SPEED ADJUSTMENT FACTOR appears to be approximately −10.

The value of the variable SPEED ADJUSTMENT FACTOR is used by motor drive circuit 38 to provide adjusted power to fan motor 34. Motor drive circuit 38 receives electrical power from the AC power line terminals that provide 120 to 220-volt AC power and increases or decreases the power provided to fan motor 34 according to the speed adjustment factor. The well known method of phase modulation is used to vary the duration of the conduction time of a triac in motor drive circuit 38. Triac conduction time is varied by modulating the bias on the gate of the triac creating a certain gate turn-on delay, relating to the AC voltage phase angle represented by the speed adjustment factor. Triacs are well known as bidirectional gate-controlled thyristors that allow for the variation of AC voltage.

Figure 6:
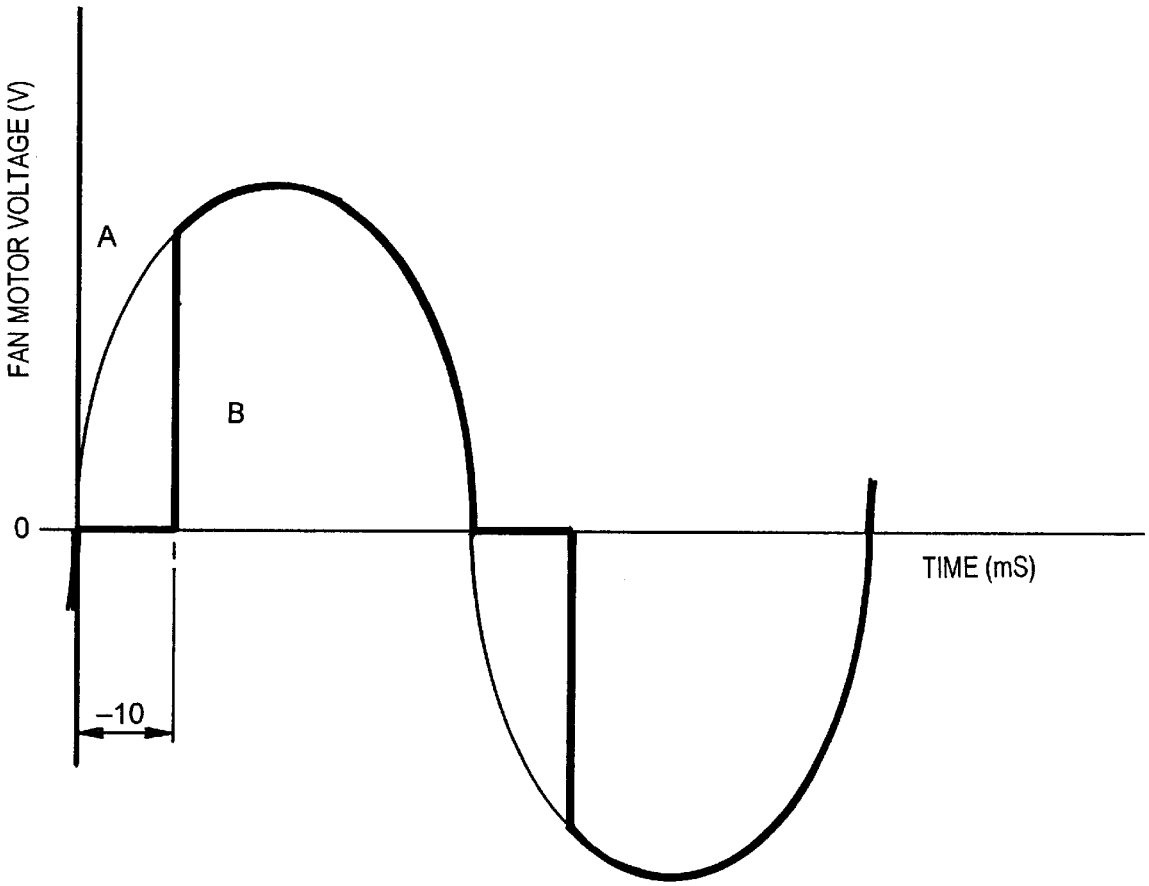
FIG. 6 is a graph showing the voltage power wave modulation achieved by the motor drive circuit of the present invention.

Referring now to FIG. 6, shown therein is an illustration of two voltages across fan motor 34 as curves A and B which result from different triac gate delay values in accordance with the AC phase modulation method described above. Curve A is the voltage produced across fan motor 34 when triac gate turn-on delay is zero and fan motor 34 will receive full power. Curve B is the voltage produced across fan motor 34 when triac gate turn-on delay is a non-zero value and accordingly fan motor 34 will receive less than full power.

The length of the triac gate turn-on delay is determined by the speed adjustment factor which corresponds to a number of "slices" of the full wave with a particular period relating to the power source characteristics. Since output power is proportional to the square mean value of the voltage across fan motor 34, the power provided by motor drive circuit 38 will be accordingly varied.

When the fuzzy controller determines that the speed of circulation fan 12 should be increased, a positive speed adjustment factor will be generated. A positive speed adjustment factor will decrease the triac gate delay, increase the duty cycle of the triac current, and provide more power to fan motor 34. When the fuzzy controller determines that fan speed should be decreased, a negative speed adjustment factor will be produced. This negative speed adjustment factor will increase triac gate delay, decrease the duty cycle of the triac current, and cause less power to be provided to fan motor 34.

In our example, the system is assumed to be initially running at full power. Accordingly, the current will constitute a full wave current as illustrated by curve A. A speed adjustment factor of −10 will result in an increase of the bias on the gate or base of the triacs of motor drive circuit 38 such that gate delay is increased by a corresponding number of "slices" of the full wave. The duty cycle of the triac current will be decreased and less power will be provided to fan motor 34. The resulting triac current is illustrated by curve B. The resulting change in fan speed causes a slower moving stream of air to pass through the heating system, which will in turn promote an increase in the temperature of the heat exchanger 28 towards the ideal operational set point.

Figure 7:
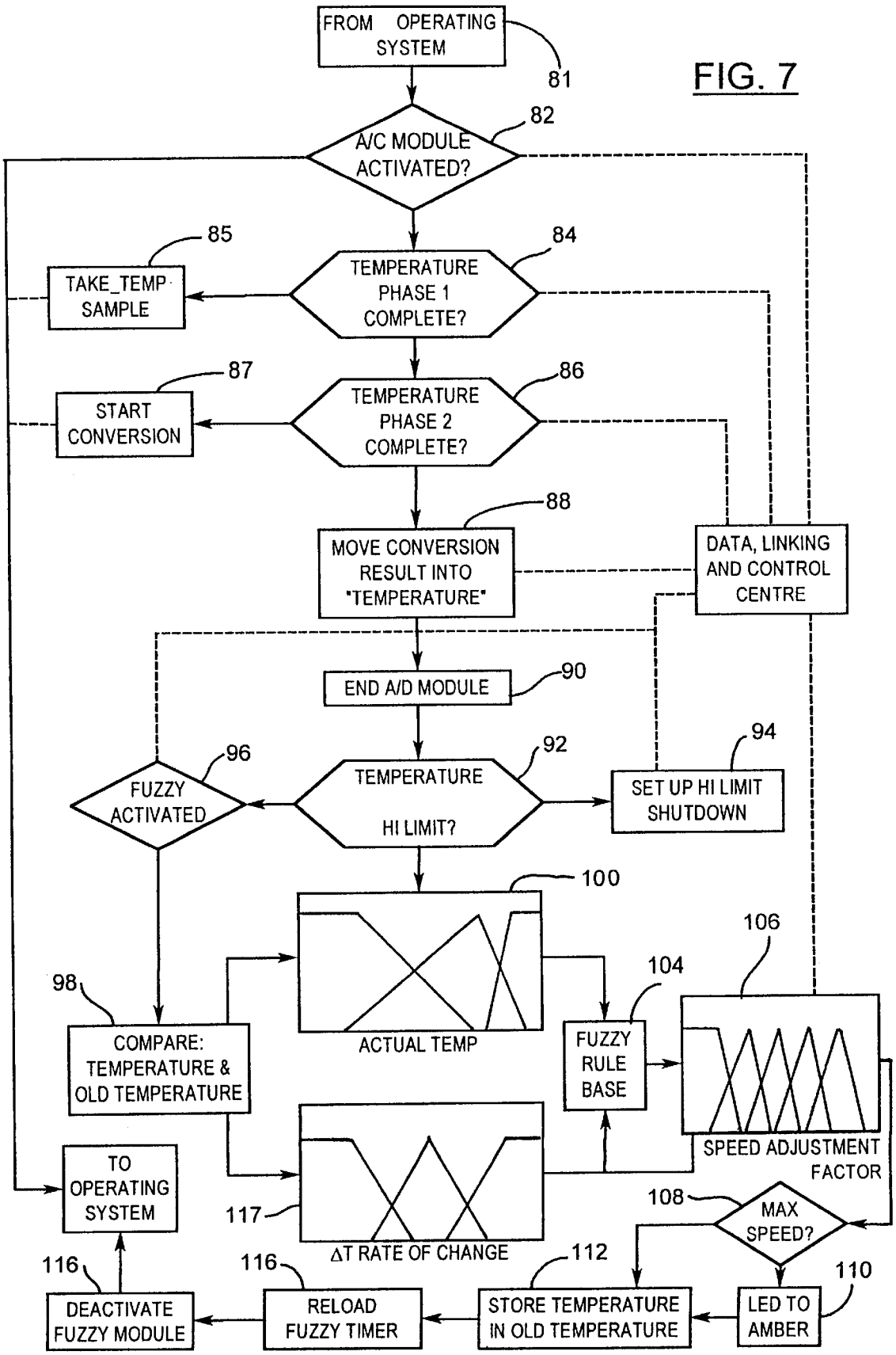
FIG. 7 is a flow chart illustrating the operation of the present invention.

With reference to FIGS. 3 and 7, the operation of control apparatus 10 is shown in use. Control apparatus 10 is implemented by microcontroller 52 in association with a proprietary operating system. At step 81, the operating system begins the control operation. At step 82, microcontroller 52 determines whether an analog-to-digital module, implementing the operation of analog to digital converter 50, has been activated. If so, microcontroller 52 at step 84 determines whether or not a temperature sample has been taken from thermocouple 44. If not, microcontroller 52 at step 85 directs the temperature sample to be taken.

If a temperature sample has been successfully obtained, microcontroller 52 at step 86 determines whether temperature information has been converted into digital form. If not, then microcontroller 52 at step 87 instructs analog to digital converter 50 to perform the conversion. If so, then microcontroller 52 inputs the digital temperature information into variable TEMP and exits the conversion module at step 90.

At step 92, microcontroller 52 determines whether the variable TEMP exceeds a preset safety limit. If so, then a high limit shutdown procedure is instigated at step 94. If not, then microcontroller 52 determines at step 96, whether the fuzzy controller has been activated. If the fuzzy controller has been activated, then variable TEMP is compared with variable OLD TEMP and their difference is stored in variable ΔTEMP at step 98.

Microcontroller 52 then utilizes the fuzzy control techniques detailed above to produce the appropriate speed adjustment factor at steps 100, 102, 104, and 106. At step 108, microcontroller 52 determines whether the speed adjustment factor requires fan motor 34 to increase in speed when fan motor 34 is already at maximum speed. If this is the case, then at step 110, microcontroller 52 will cause a LED to light with an amber colour indicating that the ideal fan speed has exceeded the motor's drive ability.

Whether or not this is the case, microcontroller 52 at step 112 stores variable TEMP as variable OLD TEMP and resets the fuzzy timer at step 114 for the next temperature sample period. The fuzzy controller module is then exited at step 116 and the operating system is reentered at step 117.

The present invention provides numerous advantages over the prior art. The use of the present invention within a forced air furnace increases heating efficiency while providing for improved occupant comfort. The use of fuzzy logic control techniques provides for a highly adaptive response to changes in air delivery and provides heating efficiency superior to less adaptive solutions. The adaptive nature of the present invention eliminates the need for air delivery calibration as part of the furnace installation procedure. In operation, the fuzzy controller of the present invention provides heat exchanger temperature fluctuations of no more than 10° F. resulting in improved occupant comfort. Further, since controller apparatus only requires a single input consisting of the temperature of heat exchangers, it is relatively inexpensive to incorporate the present invention into the manufacturing process for furnaces.

Alternative embodiments of the present invention include a controller which utilizes a basic look-up table containing temperature and temperature change ranges which would be used to correlate various temperature and temperature changes to various speed adjustment factors. The present invention may also alternatively employ other methods of affecting the speed of fan motor 34, including the use of DC motor pulse width modulation or AC motor variable frequency techniques. Finally, the present invention may alternatively be implemented in association with other internal combustion furnaces including oil furnaces.

As will be apparent to persons skilled in the art, various modifications and adaptations of the structure described above are possible without departure from the present invention, the scope of which is defined in the appended claims.

We claim:

1. A furnace air delivery control apparatus for a forced air furnace having a heat exchanger, a fan, and a fan motor, comprising:

(a) temperature sensing means operatively coupled to the heat exchanger for sensing the temperature thereof and for generating sensor signals correlatable therewith;

(b) signal conditioning means operatively coupled to the temperature sensing means for conditioning the sensor signals and generating conditioned temperature signals;

(c) a controller operatively coupled to signal conditioning means, including means for utilizing the conditioned temperature signals to continuously determine speed adjustment factors for adjusting the speed of the fan motor so as to maintain a constant air delivery, and means for generating output signals correlatable with the speed adjustment factors; and (d) speed adjusting means operatively coupled to the controller and to the fan motor, for adjusting the speed of the fan motor in accordance with the output signals.

2. The apparatus defined in claim 1, wherein the controller utilizes a linear relationship between air delivery and the temperature to determine the speed adjustment factors.

3. The apparatus defined in claim 1, wherein the signal conditioning means comprises:

(a) amplification means for amplifying the sensor signals and generating amplified sensor signals; and (b) analog to digital conversion means for converting the amplified sensor signals into digital sensor signals which constitute digital representations of the sensor signals.

4. The apparatus defined in claim 1, wherein the controller comprises:

(a) input means coupled to the signal conditioning means for receiving the conditioned temperature signals;

(b) processing means for processing the conditioned temperature signals and calculating the speed adjustment factors; and (c) output means for generating the output signals.

5. The apparatus claimed in claim 4, wherein the processing means comprises:

(a) a microprocessor; and (b) a memory connected to said processor for storing data and for further storing instructions which are executable by the processor for manipulating said data.

6. The apparatus defined in claim 1, wherein the controller implements a fuzzy logic optimizer comprising:

(a) means for processing the conditioned temperature signals into a set of input integer pair values representing the temperature of the heat exchanger and the change in temperature of the heat exchanger;

(b) means for storing instructions for performing a first set and a second set of input membership functions, each of the input membership functions when executed, producing a degree-of-membership value in accordance with the combination of one member of the input membership function set and one of the input integer pair values;

(c) means for storing data representative of a plurality of rules, each of the rules specifying elements of the input integer pair values and members of the input membership functions;

(d) means for executing input membership functions in accordance with members of the input integer pair values and accordingly forming a rule strength value for said rule; and (e) means for determining the speed adjustment factors by forming the weighted combination of each rule strength value formed in response to each of said plurality of rules.

7. The apparatus defined in claim 6, wherein each rule specifies:

(a) a first element of the input integer pair values;

(b) one member of the first set of input membership functions;

(c) a second element of the input integer pair values; and (d) one member of the second set of input membership functions.

8. The apparatus defined in claim 6, wherein means responsive to each rule for forming a rule strength value for said rule comprises:

(a) means for executing said first input membership function specified in the given rule to produce an intermediate strength value in accordance with the first member of the input integer pair values; and (b) means for executing said second input membership function specified in the given rule to produce a rule strength value for said given rule in accordance with both members of the input integer pair values.

9. The apparatus defined in claim 5, wherein the microprocessor and the memory operate cooperatively to implement a look-up table which maps ranges of values for conditioned temperature signals and ranges of differences of conditioned temperature signals to a look-up table entry to determine the speed adjustment factors.

10. The apparatus defined in claim 1, wherein the temperature sensing means comprises a thermocouple.

11. The apparatus defined in claim 3, wherein the analog to digital conversion means consists of a 8 bit analog to digital converter.

12. The apparatus defined in claim 1 wherein the speed adjusting means comprises power varying means for varying the power being provided to the fan motor.

13. The apparatus defined in claim 12, wherein the power varying means comprises AC phase modulation means for phase modulating the power wave to vary the power being provided to the fan motor.

14. The apparatus defined in claim 12, wherein the power varying means comprises AC variable frequency means to vary the frequency of the power wave to vary the power being provided to the fan motor.

15. The apparatus defined in claim 12, wherein the power varying means comprises DC pulse width modulation means for adjusting the pulse width of the power wave to vary the power being provided to the an motor.

16. A method for controlling furnace air delivery, comprising the steps of:

(a) sensing the temperature of the heat exchanger and generating sensor signals correlatable therewith;

(b) conditioning the sensor signals and generating conditioned temperature signals;

(c) processing the conditioned temperature signals and continuously determining speed adjustment factors based thereupon and generating output signals correlatable with the speed adjustment factors;

(d) adjusting the speed of the fan motor based on the output signals.

17. The method defined in claim 16, wherein said method of conditioning the sensor signals comprising the steps of:

(a) amplifying the sensor signals and generating amplified sensor signals; and (b) converting the amplified sensor signals into the digital sensor signals which constitute digital representations of the sensor signals.

18. The method defined in claim 16, wherein said method of determining speed adjustment factors comprising the steps of:

(a) receiving the conditioned temperature signals;

(b) processing the conditioned temperature signals and calculating the speed adjustment factors; and (c) generating the output signals.

19. The method defined in claim 16, wherein said method of determining speed adjustment factors uses a fuzzy logic optimization method comprising the steps of:

(a) processing the conditioned temperature signals into a set of input integer pair values representing the temperature of the heat exchanger and the change in temperature of the heat exchanger;

(b) storing instructions for performing a first set and a second set of input membership functions, each of the input membership functions when executed, producing a degree-of-membership value in accordance with the combination of one member of the input membership function set and one of the input integer pair values;

(c) storing data representative of a plurality of rules, each of the rules specifying elements of the input integer pair values and members of the input membership functions;

(d) executing input membership functions in accordance with members of the input integer pair values and accordingly forming a rule strength value for said rule; and (e) determining the speed adjustment signal by forming the weighted combination of each rule strength value formed in response to each of said plurality of rules.

20. The method defined in claim 19, wherein the fuzzy logic optimization method incorporates a method for forming rule strength values for said rules, comprising the steps of:

(a) executing said first input membership function specified in the given rule to produce an intermediate strength value in accordance with the first member of the input integer pair values; and (b) executing said second input membership function specified in the given rule to produce a rule strength value for said given rule in accordance with both members of the input integer pair values.

* * * * *